US005881906A

United States Patent [19]

Rogers et al.

[11] Patent Number: 5,881,906

[45] Date of Patent: Mar. 16, 1999

[54] WALL CONSTRUCTION FOR A SILVERWARE BASKET

[75] Inventors: Pamela Sue Rogers; Ralph E. Christman, both of St. Joseph, Mich.

[73] Assignee: Whirlpool Corporation, Benton Harbor, Mich.

[21] Appl. No.: 986,067

[22] Filed: Dec. 5, 1997

[51] Int. Cl.[6] ..... B65D 6/08

[52] U.S. Cl. ..... 220/607; 220/494; 220/DIG. 6; 220/488

[58] Field of Search ..... 220/676, 607, 220/494, 572, 23.87, 628, 636, 635, 668, DIG. 6, 487, 488; 206/557

[56] References Cited

U.S. PATENT DOCUMENTS

| | | | |
|---|---|---|---|
| 499,951 | 6/1893 | Baird | 220/572 |
| 2,732,696 | 1/1956 | Baker | 206/557 |
| 2,754,024 | 7/1956 | Planeta | 220/572 |
| 2,864,509 | 12/1958 | Watral | 220/487 |
| 4,157,145 | 6/1979 | Jordan | 220/19 |
| 4,192,432 | 3/1980 | Jordan | 220/83 |
| 4,339,051 | 7/1982 | Crawford | 220/66 |
| 4,478,344 | 10/1984 | Rehrig | 220/676 |
| 5,385,261 | 1/1995 | Lippisch et al. | 220/572 |

*Primary Examiner*—Stephen Castellano
*Attorney, Agent, or Firm*—Joel M. Van Winkle; Robert O. Rice; Thomas A. Schwyn

[57] ABSTRACT

A silverware basket for use in a dishwashing machine, the basket having a bottom wall disposed along the basket bottom. The bottom wall being an offset grid type structure formed by a plurality of parallel longitudinal ribs extending lengthwise across the basket bottom in a first plane and a plurality of parallel, transverse ribs extending across the width of the basket bottom in second plane spaced a predetermined distance below and parallel to the first plane. A plurality of connecting ribs connect the longitudinal ribs and the transverse ribs at the projected intersection points between the longitudinal ribs and the transverse ribs. A plurality of projections extend from the transverse ribs downwardly away from the longitudinal ribs for providing drip off tips for the bottom wall. The plurality of projections align with the plurality of connecting ribs and each of the projections comprise a generally inverted frustoconical body having a fully radiused bottom tip.

8 Claims, 1 Drawing Sheet

10
12
16
18
20
22
24
26
30
32
34
34a
36
38
40
42
44
44a
44b
48

WALL CONSTRUCTION FOR A SILVERWARE BASKET

BACKGROUND OF THE INVENTION

1. Field of the Invention

This invention relates generally to the field of dishwashers and more particularly to silverware baskets for dishwashers.

2. Description of Related Art

Silverware in a dishwasher is generally more difficult to dry than other items. This difficulty is due, at least in part, to the retention of washing liquid on the peripheral walls of the silverware basket such as on ledges, in pockets or by bridging of the side and bottom wall openings. The wash liquid retained on the basket walls readily contacts the silverware supported in the silverware basket and blocks the openings and air movement through the bottomed wall of the silverware basket preventing the silverware from being thoroughly and completely dried.

Various efforts have been made to improve drainage of wash liquid from the walls of a silverware basket. U.S. Pat. No. 4,192,432 discloses a silverware basket having side and end walls which include vertical and diagonal intersecting ribs forming a lattice-work of perforations which promotes natural, gravitational drainage of washing fluid from the walls. U.S. Pat. No. 4,157,145 discloses a silverware basket having a bottom wall which includes first and second pluralities of elongated ribs disposed in two generally parallel but spaced apart planes. The ribs are joined at the projected rib intersections and thus form an offset grid having non-planar openings which resist bridging by washing fluid.

While these past efforts have resulted in improved liquid drainage from the walls of a silverware basket, there still exists a need for additional improvements as silverware drying performance remains a point of customer dissatisfaction.

SUMMARY OF THE INVENTION

Accordingly, the present invention is directed to an improved silverware basket which reduces the retention of liquid on the basket walls and resultant blockage of air movement through the basket bottom wall by promoting drainage therefrom.

Accordingly, the present invention provides for a silverware basket for use in a dishwashing machine, the basket having a bottom wall disposed along the basket bottom. The bottom wall includes a plurality of parallel longitudinal ribs extending lengthwise across the basket bottom in a first plane and a plurality of parallel, transverse ribs extending across the width of the basket bottom in second plane spaced a predetermined distance below and parallel to the first plane. A plurality of connecting ribs connect the longitudinal ribs and the transverse ribs at the projected intersection points between the longitudinal ribs and the transverse ribs. A plurality of projections extend from the transverse ribs downwardly away from the longitudinal ribs for providing drip off tips for the bottom wall. The plurality of projections align with the plurality of connecting ribs and each of the projections comprise a generally inverted frustoconical body having a fully radiused bottom tip.

DESCRIPTION OF THE PREFERRED EMBODIMENT

Figures 1, 2, 3, 4:
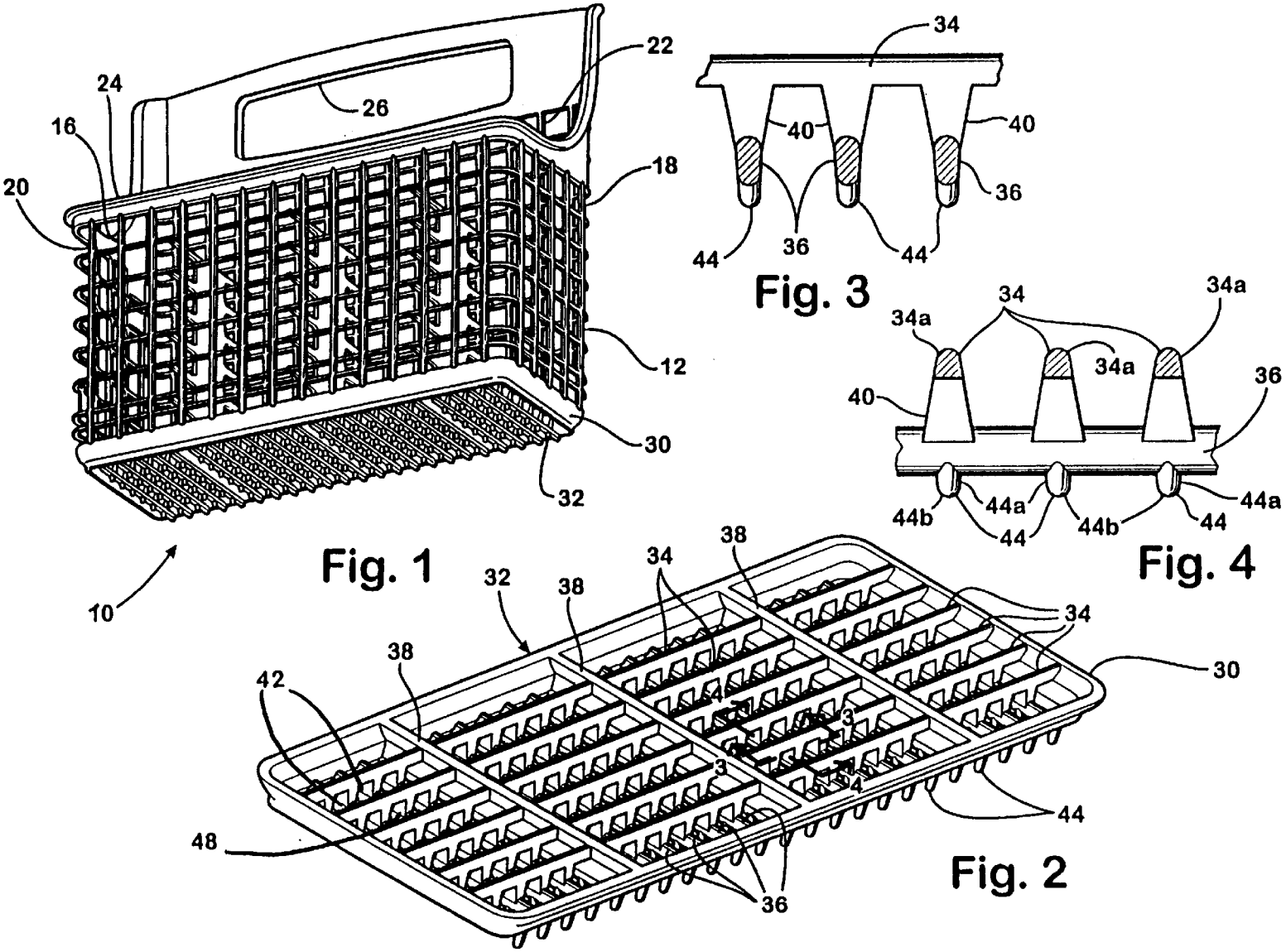
FIG. 1 is a front view of a silverware basket embodying the present invention.
FIG. 2 is a perspective view of the bottom wall of the silverware basket of FIG. 1.
FIG. 3 is a view taken along line 3—3 in FIG. 2.
FIG. 4 is a view taken along line 4—4 in FIG. 2.

FIG. 1 illustrates a silverware basket designated generally 10 embodying the present invention. The basket is preferably a molded plastic part having a basket body 12. The basket body 12 includes a front wall 16, side walls 18, 20 and a back wall 22 wherein all of the walls 16, 18, 20 and 22 may be generally referred to as side walls. The side walls 16, 18, 20, 22 are molded in a lattice work of grid-like arrangement to allow the ingress of wash liquid for cleaning the silverware placed within the basket while at the same time preventing the egress of silverware from the silverware basket 10. A flanged frame 24 is provide about the upper periphery of the walls 16, 18 20, 22. A handle 26 is formed into the upper portion of the back wall 22. A bottom frame 30 is provided about the bottom edges of the side walls 16, 18, 20, 22. The bottom frame comprises elongated rail members having a radiused wall cross section such that the basket 10 is provided with rounded bottom edges. A bottom wall 32 is provided within the bottom frame 30.

The construction of the bottom wall 30 is shown in greater detail in FIGS. 2–4. The bottom wall 30 is an offset grid or lattice type structure formed by two sets of elongated ribs provided in separate, spaced apart planes. A first plurality of parallel, longitudinal ribs 34 extend lengthwise across the bottom of the basket 10 in a first plane. A second plurality of parallel, transverse ribs 36 extend across the width of the basket 10 in a second plane positioned a predetermined distance below the first plane such that the longitudinal ribs 34 and the transverse ribs 36 are vertically offset from each other. A plurality of stiffening ribs 38 extend transversely the width of the basket bottom to give strength to the bottom wall 32. The stiffening ribs 38 extend in height from the plane defined by the tops of the longitudinal ribs 34 to the plane defined by the bottoms of the transverse ribs 36.

The cross section of the ribs 34 and 36 are such as to optimize water drainage from the ribs. The longitudinal ribs 34 have a cross sectional shape comprising a triangle having a fully radiused apex 34*a*. The transverse ribs 36 have a cross sectional shape comprising an inverted triangle with a full radius at both the base and the apex.

The parallel, vertically spaced apart, horizontal planes defined by the longitudinal ribs 34 and the transverse ribs 36 are joined at their projected points of intersection by a plurality of connecting ribs 40. The projected points of intersection are defined by the points where the longitudinal ribs 34 overlie the transverse ribs 36. The height of these the connecting ribs 40 determines the spaced apart distance between the planes of the ribs. Each of the connecting ribs 40 generally forms a hexahedral member have a upper end connected to one of the longitudinal ribs 34 and a bottom end connected to one of the transverse ribs 36. The side walls 42 of the connecting ribs 40 are angled to facilitate molding.

The geometry of the bottom wall 32 causes any liquid film to be on multiple planes. The transition regions between the planes causes high stress in the liquid film which further causes the bridging film to break.

The bottom wall 32 further includes a plurality of projections 44 extending downwardly from the transverse ribs 36 on the side opposite the longitudinal ribs 34. The plurality of projections 44 each comprise a generally inverted frustoconical body 44*a* having a fully radiused bottom tip 44*b*.

The projections 44 are located on the transverse ribs 36 opposite the connecting ribs 40 such that the projections 44 align with the projected points of intersection between the ribs 34 and 36. The projections 44 provide drip off points for wash liquid which is draining from the basket walls. The relatively large attraction of water molecules for the surface of the ribs and gravity causes the wash liquid to adhere and cling to the underside of the ribs. By directing liquid down along the projections 44, the surface area of the contact between droplets of wash liquid and the bottom wall 32 is reduced thereby allowing the weight of the water to pull the droplets off the projections 44. Further, the drops formed on the projections 44 are generally connected by a surface film to any bridging film. The weight of the drops pulls the surface film and in turn the bridging film. The pulling action lengthens and reduces the cross sectional area minimizing surface tension and breaking any connected bridging film.

The resulting offset lattice configuration formed by the longitudinal ribs 34, the transverse ribs 36, connecting ribs 40 and the projections 44 produces an irregular bottom wall surface having openings 48 which adequately support silverware within the basket 10 but which provides for a relatively large amount of spacing between the ribs 34 and 36. The spacing between the ribs 34 and 36 is such that bridging of water between the ribs is not probable. The irregular bottom wall surface therefore promotes silverware drying by minimizing the amount of wash liquid which is trapped on the bottom wall 32 or which bridges between adjacent ribs. Moreover, the projections 44 provide drip off tips such that wash liquid readily drops off the transverse ribs 36 rather than adhering to the undersides of the ribs 36.

It can be seen, therefore, that the present invention provides for an improved bottom wall for a silverware basket in a dishwasher. In particular, the projections 44 facilitate wash liquid removal from the bottom wall and significantly improve drying performance. While the present invention has been described with reference the above described embodiments, those of skill in the Art will recognize the changes may be made thereto without departing from the scope of the invention as set forth in the appended claims.

We claim:

1. A silverware basket for use in a dishwashing machine, the basket comprising:

a plurality of upstanding side walls having a grid type construction through which wash liquid may pass, each of the side walls further having a bottom edge; and a bottom wall interconnected with the bottom edges of the side walls, the bottom wall having:

a plurality of parallel longitudinal ribs, the longitudinal ribs extending lengthwise across the basket bottom in a first plane;

a plurality of parallel, transverse ribs, the transverse ribs extending across the width of the basket bottom in second plane spaced a predetermined distance below and parallel to the first plane;

a plurality of connecting ribs connecting the longitudinal ribs and the transverse ribs at the projected intersection points between the longitudinal ribs and the transverse ribs; and a plurality of projections extending from the transverse ribs away from the longitudinal ribs for providing drip off tips for the bottom wall wherein the plurality of projections align with the plurality of connecting ribs.

2. The silverware basket according to claim 1, further wherein the plurality of projections align with the plurality of connecting ribs and the number of projections corresponds to the number of connecting ribs.

3. The silverware basket according to claim 1, further wherein the plurality of projections each comprise a generally inverted frustoconical body having a fully radiused bottom tip.

4. The silverware basket according to claim 1, further wherein each of the longitudinal ribs have a cross sectional shape comprising a triangle having a fully radiused apex.

5. A silverware basket for use in a dishwashing machine, the basket comprising:

a plurality of upstanding side walls having a grid type construction through which wash liquid may pass, each of the side walls further having a bottom edge; and a bottom wall interconnected with the bottom edges of the side walls, the bottom wall having:

a first plurality of parallel, elongated ribs arranged in a first plane;

a second plurality of parallel, elongated ribs arranged in a first second plane spaced a predetermined distance below and parallel to the first plane, the first plurality of parallel, elongated ribs oriented at an angle to the second plurality of ribs for forming a plurality of intersection points where the first plurality of parallel, elongated ribs overlie the second plurality of parallel, elongated ribs;

a plurality of connecting ribs provided at the plurality of intersection points extending between the first plurality of parallel, elongated ribs and the second plurality of parallel, elongated ribs; and a plurality of projections extending from the second plurality of parallel, elongated ribs away from the first plurality of parallel, elongated ribs wherein the plurality of projections align with the plurality of connecting ribs.

6. The silverware basket according to claim 5, further wherein the plurality of projections align with the plurality of connecting ribs and the number of projections corresponds to the number of connecting ribs.

7. The silverware basket according to claim 5, further wherein the plurality of projections each comprise a generally inverted frustoconical body having a fully radiused bottom tip.

8. The silverware basket according to claim 5, further wherein each of the first plurality of parallel, elongated ribs have a cross sectional shape comprising a triangle having a fully radiused apex.

* * * * *